United States Patent [19]

Ivanov et al.

[11] 4,165,253

[45] Aug. 21, 1979

[54] PROCESS FOR PRODUCING PULP

[76] Inventors: Mikhail A. Ivanov, Severny prospekt, 73, korpus 3, kv. 51; Vladimir G. Ushakov, Grazhdansky prospekt 104, korpus 1, kv. 210; Vitaly M. Krjukov, ulitsa Novosibirskaya, 21, kv. 13; Viktor I. Losik, Kondratievsky prospekt, 79, kv. 159; Vasily I. Sorokin, prospekt Morisa Toreza, 104, korpus 3, kv. 41, all of Leningrad; Avgust V. Osipov, Leninsky prospekt, 52, kv. 265, Moscow; Valery S. Gromov, ultisa Gorkogo, 27/29, kv. 38; Jury S. Khrol, ulitsa Daugavgrivas, 13, kv. 4, both of Riga; Galina G. Bakina, Zavodskoi pereulok, 11, Lomonosov Leningradskoi oblasti; Semen I. Andabursky, ulitsa Lenina, 399, kv. 43, Riga; Valery G. Kenin, prospekt Junogo Lenintsa, 75, kv. 8, Lomonosov Leningradskoi oblasti; Tatyana K. Vasilevskaya, Izmailovsky prospekt, 12, kv. 11; Ljudmila I. Stolyarova, ulitsa Dvinskaya, 9, kv. 16, both of Leningrad; Ella J. Beizer, ulitsa Zverinskaya, 17-b, kv. 25, Leningrad, all of U.S.S.R.

[21] Appl. No.: 927,592

[22] Filed: Jul. 20, 1978

[51] Int. Cl.[2] ..... D21C 3/16

[52] U.S. Cl. ..... 162/19; 162/50; 162/51; 162/29; 162/81; 162/90

[58] Field of Search ..... 162/19, 50, 51, 81, 162/90, 29

[56] References Cited

U.S. PATENT DOCUMENTS

| | | | |
|---|---|---|---|
| 2,110,546 | 3/1938 | Dreyfus | 162/81 |
| 3,726,756 | 4/1973 | Polak | 162/50 |

OTHER PUBLICATIONS

Paper Trade Journal, Dec. 18, 1972, pp. 36–37.

*Primary Examiner*—S. Leon Bashore
*Assistant Examiner*—William F. Smith
*Attorney, Agent, or Firm*—Haseltine, Lake & Waters

[57] ABSTRACT

The process for producing pulp according to the present invention consists in the subsequent steps of an aqueous treatment of a vegetable stock at a temperature within the range of from 110° to 170° C. under a pressure of from 2 to 7 atm.g. for a period of from 0.3 to 4 hours at a weight ratio of the vegetable stock to water of 1:2–4 respectively; a simultaneous impregnation and cooking of said vegetable stock in a solution of nitric acid at a temperature of from 70° to 90° C. for 0.5–3 hours; cooking at a temperature of from 100° to 130° C. under a pressure of from 1 to 4 atm.g. for 0.3–0.5 hour; an alkali extraction of the vegetable stock; decontamination of the gaseous cooking products by mixing thereof with the air in a volumetric ratio of 1:0.5–1 respectively, and treatment with the spent liquor resulting from the stage of alkali extraction.

The process according to the present invention makes it possible to increase the yield of pulp and substantially improve its quality characteristics.

4 Claims, No Drawings

PROCESS FOR PRODUCING PULP

FIELD OF APPLICATION

The present invention relates to the production of fibrous prefabricated articles and, more specifically, it relates to a process for producing pulp useful in the pulp-paper industry and in chemical industry as the starting material for the manufacture of man-made fibres.

BACKGROUND OF THE INVENTION

Known in the art are processes for producing pulp which comprise impregnation of vegetable raw materials such as wood chips with a solution of nitric acid, cooking in a vapour-gas or liquid medium, followed by alkali extraction.

Concentration of nitric acid is varied within the range of from 3 to 42% by weight and the impregnation temperature depends on concentration of acid and is varied within the range of from 12° C. (for a concentrated acid) to the boiling temperature (in the case of diluted solutions). Duration of impregnation is determined by the technology employed and is varied from several minutes to 18 hours and more.

To accelerate the process of impregnation of the vegetable raw materials and ensure a uniform distribution of nitric acid therein, various methods for intensification of this operation have been developed.

These are exemplified by impregnation of the vegetable stock with acid in vacuum, setting wood chips under vacuum prior to supply of nitric acid into the apparatus, followed by elevation of pressure up to 3 atm.g; disintegration of the vegetable stock and the use thereof in the form of thin shavings as well as keeping of the impregnated vegetable stock at a temperature within the range of from 40° to 80° C. for a period of from 3 to 5 hours to equalize the concentration of the initially absorbed acid over the entire volume of the vegetable stock. There is also a method comprising mechanical compression and decompression of a vegetable stock submerged into a solution of nitric acid thrice elevating and diminishing the pressure in alternation.

However, the use of said operations prior to impregnation of the vegetable stock with a solution of nitric acid does not ensure a required uniformity of distribution of acid in the vegetable stock which causes a substantial amount of a non-cooked product (wastes) lowering the yield of the final pulp.

Furthermore, the resulting pulp has an insufficient mechanical strength and a low viscosity of its cuprammonium solutions.

In the prior art processes for the production of pulp the vegetable stock impregnated with a solution of nitric acid is subjected to cooking in a liquid or vapour-gas medium. It is advisable to use the following conditions, namely: maintaining the vegetable stock under atmospheric pressure at a temperature of from 96° to 99° C. for a period of from 0.5 to 1.5 hour. At the temperature of 98°–99° C. there are formed about $50^3$m of gaseous products per 1 ton of the vegetable stock. The volume of the gaseous mixture formed during the cooking is decreased with decreasing the process temperature; however, the cooking duration is increased from 7 to 10 hours.

The main disadvantage of the prior art processes for the production of pulp upon cooking under the above-described conditions is the formation of pulp containing a considerable amount of hemi-cellulose which exerts a detrimental effect on the quality of the final pulp product. Furthermore, in the prior art processes for the production of pulp there is lack of processes of decontamination of the gaseous products of the cooking which results in pollution of the environments.

Also known in the art is a process for producing pulp from a vegetable stock including steaming effected by passing a live steam through a bed of the vegetable stock for 0.3–0.5 hour, impregnation of the vegetable stock with nitric acid having concentration of from 6 to 15% by weight at a temperature within the range of from 40° to 50° C. under atmospheric or an overatmospheric pressure; cooking in a liquid or vapour-gas mixture at a temperature of 96°–99° C. accompanied by liberation of toxic products, and an alkali extraction. The alkali extraction is effected by means of aqueous solutions of caustic soda, potash, soda, ammonia, calcium hydroxide or a mixture thereof. This process makes it possible to produce pulp with a yield of up to 45% by weight and containing up to 89% of alpha-cellulose and down to 12% of hemi-celluloses. This pulp, however, does not possess the required quality parameters.

This prior art process has the following disadvantages: a long duration of the impregnation stage, non-uniformity of impregnation of the vegetable stock with nitric acid resulting in a large amount of under-cooking, a high content of hemi-celluloses, absence of decontamination of the gaseous cooking products.

OBJECT OF THE INVENTION

It is an object of the present invention to increase the yield of pulp.

It is another object of the present invention to improve quality characteristics of pulp.

BRIEF DESCRIPTION OF THE INVENTION

These objects are accomplished by that in a process for producing pulp from a vegetable stock by impregnation thereof with a solution of nitric acid, cooking in a liquid or vapour-gas medium and an alkali extraction of the thus-treated vegetable stock, in accordance with the present invention, the vegetable stock is first pretreated with water at a weight ratio of the vegetable stock to water of 1:2–4 respectively and at a temperature of from 110° to 170° C. under a pressure of from 2 to 7 atm.g. for a period of from 0.3 to 4.0 hours followed by a simultaneous impregnation and cooking of the vegetable stock in a solution of nitric acid at a temperature within the range of from 70° to 90° C. for a period of from 0.5 to 3.0 hours with a subsequently continued cooking at a temperature within the range of from 100° to 130° C. under a pressure of from 1 to 4 atm.g. for 0.3–0.5 hour; the gaseous products resulting from cooking of the vegetable stock are decontaminated by intermixing with air in a volumetric ratio of 1:0.5–1.0 respectively with a subsequent treatment with the spent liquor resulting from the alkali extraction stage.

The above-mentioned aqueous treatment contributes to the formation of a more porous structure of the vegetable stock which facilitates a more complete and uniform impregnation thereof with a solution of nitric acid and lowers the amount of under-cooking, i.e., increases the yield of pulp. At the same time, the content of hemi-celluloses is reduced and the content of alpha-celluloses is increased which ameliorates quality characteristics of the resulting pulp.

The use of the above-mentioned aqueous treatment of the vegetable stock makes it possible to perform simultaneously the process of impregnation and cooking of the vegetable stock in a solution of nitric acid, thus substantially improving quality characteristics of the resulting pulp product and substantially reducing the total duration of the process for the manufacture of pulp.

The subsequent elevation of the cooking temperature ensures a rapid completion of the residual lignin with nitric acid, elimination of the maximal amount of hemicelluloses and the achievement of the required quality characteristics of pulp. At a temperature above 130° C. the cooking is inexpedient, since a noticeable destruction of pulp is observed.

Decontamination of the gaseous products resulting from cooking of the vegetable stock makes it possible to eliminate pollution of the environment with toxic gaseous compounds without any additional consumption of chemicals for purification. At the same time, there is ensured an increased content of combined nitrogen in the spent liquor which should increase its value as an agricultural fertilizer.

In the process according to the present invention it is advisable to perform simultaneous cooking and impregnation of the vegetable stock in a solution of nitric acid under a continuous vibroagitation at a frequency of mechanical vibrations of about 3,000 per minute. Owing to vibroagitation nitric acid penetrates into the vegetable stock at a substantially higher speed than in a conventional impregnation process without vibroagitation. The use of vibroagitation in the process according to the present invention makes it possible to substantially intensify the same while increasing the output from the process equipment as well.

It is advisable to subject the spent liquor resulting from the alkali extraction stage to oxidation with an oxygen-containing gas at a temperature within the range of from 200° to 250° C. under a pressure of from 10 to 30 atm.g. for a period of from 0.5 to 2 hours and to use it repeatedly in said stage of alkali extraction.

It is preferable, in the stage of simultaneous impregnation and cooking of the vegetable stock, to use a 3–10% solution of nitric acid.

DETAILED DESCRIPTION OF THE INVENTION

The process for producing pulp from a vegetable stock according to the present invention is performed in the following manner.

As a vegetable stock use can be made of deciduous and coniferous wood, cotton stems, sugar cane wastes, straw.

The vegetable stock is poured with water at a weight ratio of 1:2–4 respectively and heated in an autoclave under a pressure of from 2 to 7 atm.g. at a temperature of from 110° to 170° C. for a period of from 0.3 to 4.0 hours.

This pretreatment with water is accompanied with hydrolysis and dissolution of a certain amount of readily-hydrolyzable hemi-celluloses and water-soluble lignin fragments A partial dissolution of the vegetable material results in the formation of a more porous and permeable structure of the vegetable stock which further facilitates a more complete and uniform impregnation thereof with nitric acid which makes possible to accelerate the process and reduce the amount of undercooked material. Furthermore, the thus-produced pulp features a substantially lower content of hemicelluloses and a higher content of alpha-celluloses.

On completion of the water-treatment the vegetable stock is mixed with a solution of nitric acid of a concentration of from 2 to 12% by weight and heated at a temperature within the range of from 70° to 90° C. for a period of from 0.5 to 3.0 hours; therewith, two processes occur simultaneously, namely: impregnation and cooking of the vegetable stock. This ensures most optimal conditions for a uniform cooking of the vegetable stock which substantially improves quality of the resulting cellulose. Then the reaction mass is continued to be heated to the temperature of 130° C. for a period of from 0.3 to 0.5 hour. It is preferable, to accelerate the processes of impregnation and cooking, improvement of uniformity of distribution of nitric acid over the vegetable stock, to perform impregnation with continuously operating vibroagitating means performing oscillating movements at the frequency of 50 Hz. During the vibroagitation there are formed wave-like propagating compression zones which apparently is the main reason of intensification of mass transfer in wood. Owing to the vibroagitation there is achieved a sharp acceleration of diffusion of nitric acid inside the vegetable stock.

On completion of cooking, the vegetable stock is washed and subjected to an alkali extraction with a solution of, for example, caustic soda, soda or ammonia. It is preferable, to reduce the consumption of fresh water, the base and to eliminate the formation of harmful waste waters, that the spent liquor resulting from the alkali extraction stage be subjected to oxidation with a oxygen-containing gas at a temperature within the range of from 200° to 250° C. under a pressure of from 10 to 30 atm.g. for a period of from 0.5 to 2.0 hours and repeatedly used in said alkali extraction stage.

The organic compounds contained in the spent alkaline liquor are oxidized to carbon dioxide or to simple carboxylic acid remaining in the liquor in the form of salts. All coloured compounds in the liquor are also destroyed. The resulting colourless or light-yellow solution contains carbonates, bicarbonates and salts of trivial carboxylic acids, i.e. oxalates, formiates, acetates and the like. The resulting solution possesses an alkaline reaction and can be repeatedly used for the alkaline extraction.

The gaseous products resulting from cooking of the vegetable stock are decontaminated by mixing same with air in a volumetric ratio of 1:0.5–1.0 respectively and treated with the spent liquor resulting from the alkali extraction stage.

The process for producing pulp according to the present invention has the following advantages over the prior art processes, namely: increased yield of pulp by 3–5% by weight due to a reduced amount of the non-cooked material; improved quality characteristics of pulp due to a reduced amount of hemi-celluloses from 7.6% by weight to 3.4% by weight and an increased content of alpha-cellulose from 88.6% by weight to 94% by weight.

Owing to the use of vibroagitation in the process of simultaneous impregnation and cooking of the vegetable stock in a solution of nitric acid, duration of these operations is reduced by 5–7 times. The process for producing pulp with decontamination of the gaseous cooking products makes it possible to eliminate air pollution with toxic gaseous compounds without consumption of any additional chemicals for purification.

For a better understanding of the present invention some specific Examples illustrating the process for producing pulp are given hereinbelow.

EXAMPLE 1

Asp chips containing 45 g of absolutely dry wood are subjected to water-treatment at the temperature of 120° C. under the pressure of 2 atm for 1 hour at the weight ratio between the vegetable stock and water of 1:4 respectively. Then the vegetable stock is intermixed with a 8% solution of nitric acid and impregnation and cooking are conducted simultaneously at the temperature of 80° C. for 2 hours, followed by further cooking at the temperature of 120° C. for 0.5 hour under the pressure of 2 atm.g. The extraction is performed with a 2% solution of caustic soda at a temperature of from 95° to 100° C. for 1 hour, followed by decontamination of the gaseous cooking products. The resulting pulp has the following characteristics:

| | |
|---|---|
| yield of pulp | 44.5% |
| yield of the under-cooked product | 0.6% |
| content of alpha-cellulose | 91.3% |
| content of pentosans | 5.8% |
| viscosity of a 1% cuproammonium solution, ml | 848 |
| average degree of polymerization | 1,343. |

EXAMPLE 2

Asp chips containing 45 g of absolutely dry wood are subjected to water-treatment at the temperature of 170° C. under the pressure of 7 atm.g. for 0.3 hour at the weight ratio between the vegetable stock and water of 1:2 respectively. Then the vegetable stock is mixed with a 10% solution of nitric acid and impregnation is conducted simultaneously with cooking under continuous vibroagitation (with the frequency of mechanical oscillations of about 3,000 per minute) at the temperature of 70° C. for 0.5 hour, followed by further cooking at the temperature of 100° C. for 0.5 hour under the pressure of 1 atm.g. The alkali extraction is conducted with a 1.5% solution of caustic soda at 90°-95° C. for one hour, followed by decontamination of the gaseous cooking products. The resulting pulp has the following characteristics; percent by weight:

| | |
|---|---|
| yield of pulp | 46.3% |
| yield of the non-cooked product | 0.1% |
| content of alpha-cellulose | 93.4% |
| content of pentosans | 4.1% |
| content of lignin | 0.15%. |

EXAMPLE 3

Birch chips containing 50 g of absolutely dry wood are subjected to water-treatment at the temperature of 150° C. under the pressure of 5 atm.g. for 0.5 hour at the weight ratio between the vegetable stock and water of 1:3 respectively. Then the vegetable stock is mixed with a 6% solution of nitric acid and impregnation is effected simultaneously with cooking at the temperature of 85° C. for 3 hours, followed by continuation of cooking at the temperature of 130° C. for 0.3 hour under the pressure of 4 atm.g.

The alkali extraction is carried out using a 1.5% solution of caustic soda for 1 hour, followed by decontamination of gaseous products resulting from the cooking.

The resulting pulp has the following characteristics, weight percent:

| | |
|---|---|
| yield of pulp | 48.1% |
| yield of the under-cooked product | 0.3% |
| content of alpha-cellulose | 90.1% |
| content of lignin | 0.6% |
| content of pentosans | 5.4% |

EXAMPLE 4

Birch chips containing 70 g of absolutely dry wood are subjected to water-treatment at the temperature of 110° C. under the pressure of 2 atm.g. for the period of 4 hours at the weight ratio between the vegetable stock and water of 1:4 respectively. Then the vegetable stock is mixed with a 4% solution of nitric acid and impregnation is conducted simultaneously with cooking at the temperature of 90° C. for 2.5 hours, followed by continuation of cooking at the temperature of 110° C. for 0.5 hour under the pressure of 2 atm.g.

The alkali extraction is conducted by means of a 1.5% solution of caustic soda at a temperature of from 90° to 95° C. for one hour, followed by decontamination of the gaseous cooking products. The resulting pulp has the following characteristics, weight percent:

| | |
|---|---|
| yield of pulp | 47.3% |
| yield of the under-cooked product | 0.5% |
| content of alpha-cellulose | 92.8% |
| content of lignin | 0.6% |
| content of pentosans | 5.6% |

EXAMPLE 5

Asp chips containing 244 g of absolutely dry wood are subjected to water-treatment at the temperature of 110° C. under the pressure of 2 atm.g. for 0.5 hour at the weight ratio between the vegetable stock and water of 1:4 respectively. Then the vegetable stock is mixed with a 3% solution of nitric acid and impregnation is conducted simultaneously with cooking at the temperature of 90° C. for 3 hours followed by further cooking at the temperature of 120° C. for 0.3 hour under the pressure of 3 atm.g.

The thus-treated chips are divided into four equal portions which are then used for the alkali extraction performed in the following manner:

(a) the first portion of the resulting asp chips is treated with 250 ml of a 1% soda solution at a temperature of 95°-98° C. for 1 hour. Then the spent alkali liquor is separated in the amount of 190 ml. The mass is washed with water and the first portion of the washings (60 ml) is combined with the spent liquor which is then subjected to oxidation at the temperature of 200° C. for 2 hours under the pressure of 30 atm and added with 0.5 g of sodium carbonate to replenish the losses;

(b) the second portion of the asp chips is extracted with the spent alkali liquor oxidized at the temperature of 240° C. for 0.5 hour under the pressure of oxygen of 20 atm.g. The extraction is carried out at a temperature of 95°-98° C. for one hour. Then the chips are washed and the first portion of the washings is combined with the spent liquor. The latter is again subjected to oxidation for 1.5 hour at the temperature of 200° C. and then added with 0.5 g of sodium carbonate;

(c) the third portion of the asp chips is subjected to extraction with the repeatedly oxidized spent alkali liquor described in item (b) hereinabove at a temperature of 95°–98° C. for one hour. The washings are again combined with the spent alkali liquor which is then oxidized for the third time;

(d) the fourth portion of the chips is extracted with the spent alkali liquor preliminary oxidized at the temperature of 250° C. under the pressure of 10 atm.g. for one hour. Extraction is conducted at 95°–98° C. for one hour.

Quality characteristics of the resulting pulp are shown in Table 1 hereinbelow

Table 1

| Quality characteristics | Example 5 (a) | Example 5 (b) | Example 5 (c) | Example 5 (d) |
|---|---|---|---|---|
| Yield of pulp | 51.8 | 52.8 | 53.6 | 54 |
| Yield of the under-cooked product | 2.5 | 2.1 | 2.5 | 1.8 |
| Breaking length, m | 8,200 | 8,350 | — | — |
| Bending strength, number of double inflections | 1,360 | 2,770 | — | — |
| Tear strength, g | 38 | 65 | — | — |
| Punching strength, kg/cm$^2$ | 3.5 | 3.9 | — | — |

EXAMPLE 6

The method for producing pulp is effected in a manner similar to that described in Example 1 hereinbefore.

(a) the gaseous products resulting from cooking are mixed with the air in the volumetric ratio of 1:0.5 and passed through the spent liquor resulting from extraction of asp chips with a solution of caustic soda;

(b) the gaseous products resulting from cooking are mixed with the air in the volumetric ratio of 1:1 and passed through the spent liquor resulting from extraction of asp chips with a solution of soda;

(c) the gaseous products resulting from cooking are mixed with the air in the volumetric ratio of 1:1 and passed through the spent liquor resulting from extraction of asp chips with a solution of ammonia. The test results are shown in the following Table 2.

Table 2

| Components of the gas mixture resulting from cooking of vegetable stock | Content of nitrogen oxide and dioxide in the gas mixture (vol. per cent) | | | |
|---|---|---|---|---|
| | Before decontamination | After decontamination | | |
| | | Example 6 (a) | Example 6 (b) | Example 6 (c) |
| Nitrogen oxide | 1.6 | 0.15 | 0.15 | 0.1 |
| Nitrogen dioxide | 7.8 | below 0.1 | below 0.1 | below 0.1 |

What is claimed is:

1. A process for producing pulp from a vegetable stock consisting in the subsequent steps of treating the vegetable stock with water at a temperature within the range of from 110° to 170° C. under a pressure of from 2 to 7 atm.g. for a period of from 0.3 to 4 hours at a weight ratio of the vegetable stock to water of 1:2–4 respectively; simultaneously impregnating and cooking said water treated vegetable stock in a solution of nitric acid at a temperature of from 70° to 90° C. for a period of from 0.5 to 3 hours; continuing said cooking at a temperature of from 100° to 130° C. under a pressure of from 1 to 4 atm.g. for 0.3–0.5 hour; extracting the cooked vegetable stock with alkali; decontaminating the gaseous cooking products by mixing said gaseous cooking products with air in a volumetric ratio of 1:0.5–1 respectively and passing the mixture of gaseous cooking products and air through the spent liquor resulting from the alkali extraction stage.

2. A process as claimed in claim 1, wherein said simultaneous impregnation and cooking of the vegetable stock in a solution of nitric acid is carried out at vibroagitation with a frequency of mechanical vibrations of about 3,000 per minute.

3. A process as claimed in claim 1, wherein the spent liquor resulting from said alkali extraction is subjected to oxidation with an oxygen-containing gas at a temperature of from 200° to 250° C. under a pressure of from 10 to 30 atm.g. for 0.5–2 hours and repeatedly used in said alkali extraction stage.

4. A process as claimed in claim 1, wherein a 3–10% solution of nitric acid is used for said simultaneous impregnation and cooking of the vegetable stock.

* * * * *